US006460698B1

(12) United States Patent
Wang

(10) Patent No.: US 6,460,698 B1
(45) Date of Patent: Oct. 8, 2002

(54) PLANER TOOL CASING

(76) Inventor: Jenn Liang Wang, No. 7, Avenue 6, Lane 296, Peng Yii Road, Taiping City, Taichung Hsien (TW), 411

( * ) Notice: Subject to any disclaimer, the term of this patent is extended or adjusted under 35 U.S.C. 154(b) by 15 days.

(21) Appl. No.: 09/722,225

(22) Filed: Nov. 27, 2000

(51) Int. Cl.[7] ..... B65D 69/00
(52) U.S. Cl. ..... 206/234; 206/38; 70/456 R
(58) Field of Search ..... 206/37, 37.4, 38, 206/234, 372, 373; 70/456 R; 362/119

(56) References Cited

U.S. PATENT DOCUMENTS 2,845,758 A 8/1958 Lowthian
3,712,311 A * 1/1973 Hedu ..... 132/73
4,478,330 A * 10/1984 Lin ..... 206/232
5,561,331 A * 10/1996 Suyama et al. ..... 180/287
5,617,597 A * 4/1997 Reitz ..... 7/110
5,735,005 A 4/1998 Wang ..... 7/127
5,956,985 A * 9/1999 Chang ..... 116/DIG. 1
6,044,967 A * 4/2000 Painsith ..... 206/234
6,220,973 B1 * 4/2001 Hsu ..... 473/406

* cited by examiner

*Primary Examiner*—David T. Fidei
(74) *Attorney, Agent, or Firm*—Charles E. Baxley

(57) ABSTRACT

A planer tool housing includes a plate having one or more chambers opened toward the side portion and/or the upper portion of the plate for receiving one or more tool members and for allowing the tool members to be engaged into and disengaged from the plate from the side and/or the upper portions of the plate. One or more ribs or projections or flanges may be used to retain the tool members in the plate. The tool members may include one or more pivotal tool elements for providing more tool elements. The plate may have a level, a compass, a light device and the other tools.

17 Claims, 3 Drawing Sheets

PLANER TOOL CASING

BACKGROUND OF THE INVENTION

1. Field of the Invention

The present invention relates to a tool housing, and more particularly to a planer tool housing.

2. Description of the Prior Art

Various kinds of typical tool boxes or cases have been widely developed and used today and comprise a huge volume that may not be disposed in the pockets of the users. Some of the tools may include one or more housings formed therein for receiving the tool members. For example, U.S. Pat. No. 5,735,005 to Wang discloses one of the typical tools having a chamber provided or formed therein for receiving the tool members, and a cover secured to the tools for enclosing the chamber of the tool and for retaining the tool members in the tool members. The tools also include a huge volume that may not be disposed in the pockets of the users.

U.S. Pat. No. 2,845,758 to Lowthian discloses the other typical tool holder or package including a rigid sheet having a number of cut out portions for receiving the tool members, and having a number pairs of bendable flaps for retaining the tool members within the rigid sheet. The tool members are required to be forced into the rigid sheet from the front portion thereof and may not be engaged into the side portions of the rigid sheet. The tool holder also may not be engaged into the pockets of the users.

The present invention has arisen to mitigate and/or obviate the afore-described disadvantages of the conventional tool housings.

SUMMARY OF THE INVENTION

The primary objective of the present invention is to provide a planer tool housing including one or more chambers opening toward the side portions of the tool housing for allowing the tool members to be engaged into and removed from the side portions of the planer tool housing.

The other objective of the present invention is to provide a planer tool housing including a number of tool members engaged therein and including a pocket size for engaging into the pockets of the users.

In accordance with one aspect of the invention, there is provided a planer tool housing comprising a plate body including an upper portion and a side portion, and including at least one chamber formed therein and opening toward the side portion of the plate body, and a tool member received in the chamber of the plate body and allowed to be engaged into and disengaged from the plate body from the side portion of the plate body. The plate body of the planer tool housing includes a pocket size for engaging into the pockets of the users such that the planer tool housing may be easily carried by the users.

The chamber of the plate body is formed in the side portion and the upper portion of the plate body for allowing the tool member to be exposed at the side portion and the upper portion of the plate body and for allowing the tool member to be engaged into and disengaged from the plate body from the side portion and the upper portion of the plate body.

A retaining device is further provided for retaining the tool member in the plate body and includes at least one project ion extended from the plate body and extended inward of the chamber of the plate body for engaging with the tool member and for retaining the tool member in the plate body.

The tool member includes at least one cavity formed therein for receiving the projection and for retaining the tool member in the plate body.

The plate body includes a rib extended inward of the chamber of the plate body for engaging with the tool member and for retaining the tool member in the plate body.

The tool member includes at least one engaging aperture and at least one notch formed therein for receiving an object to be driven by the tool member.

The tool member includes a depression formed therein for facilitating a disengagement of the tool member from the plate body.

The tool member includes at least one tool element pivotally secured thereto. The tool member includes a peripheral portion having a reduced thickness than that of the tool member for engaging into the chamber of the plate body and for defining a peripheral shoulder in the tool member and for engaging with the plate body.

The tool member includes a bulge extended therefrom, the plate body includes a slot formed therein and communicating with the chamber thereof for receiving the bulge of the tool member.

The plate body includes a pair of flanges extended inward of the chamber of the plate body for defining the slot of the plate body.

The tool member includes a swelling extended therefrom, the plate body includes an orifice formed therein and communicating with the slot of the plate body for receiving the swelling of the tool member.

The plate body includes an opening formed therein and communicating with the chamber of the plate body for facilitating a disengagement of the tool member from the plate body.

The plate body further includes one or more levels and one or more compasses and one or more light devices, and one or more graduations and includes one or more key chains coupled to the plate body for providing various kinds of tool members in the plate body. The planer tool housing thus may include various kinds of tool members and/or tool elements therein for conducting various kinds of works.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
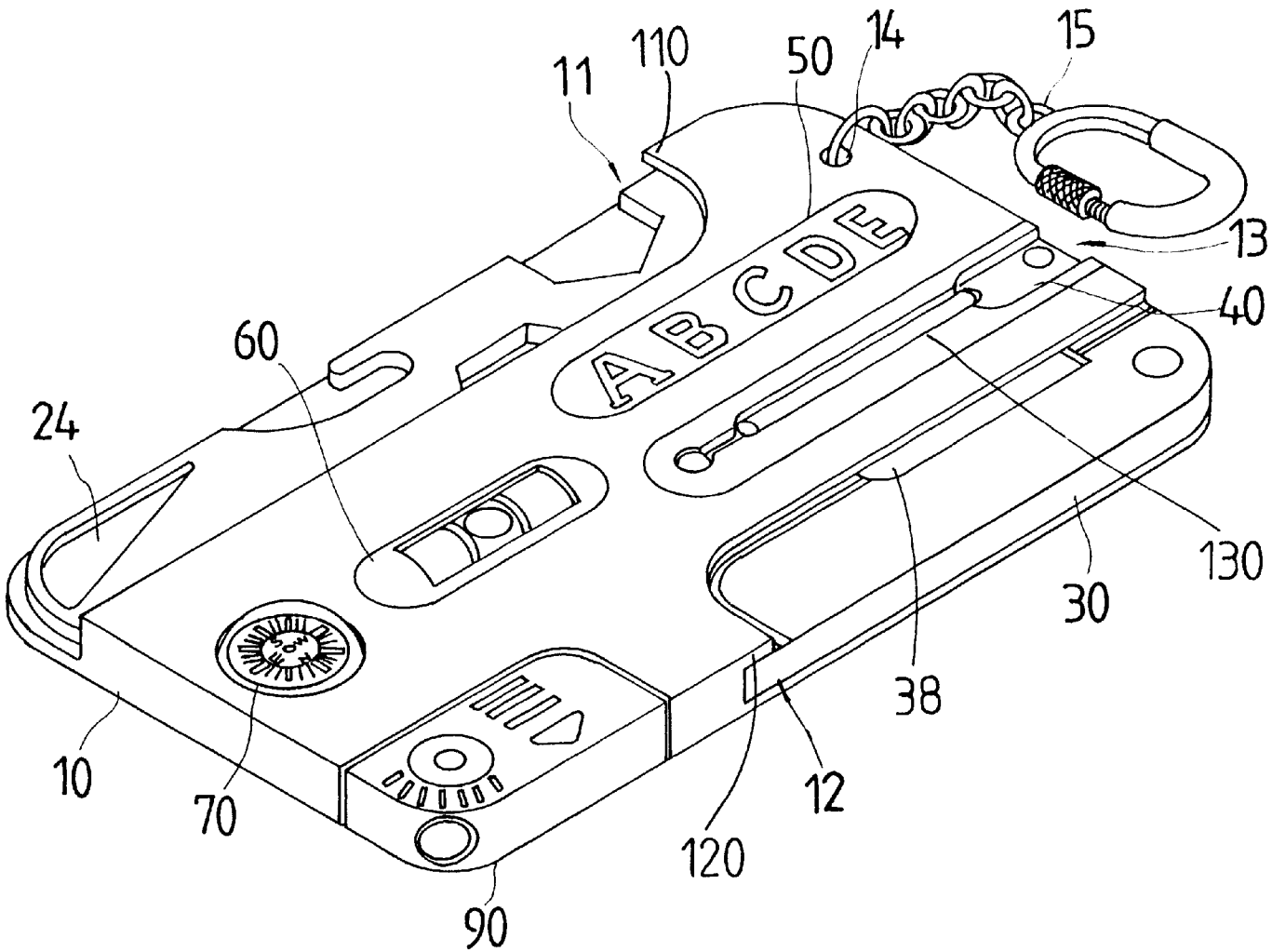
FIG. 1 is a perspective view of a planer tool housing in accordance with the present invention.

Referring to the drawings, a planer tool housing in accordance with the present invention comprises a planer plate body 10 including one or more chambers 11, 12, 13 formed therein and opening toward the side portion or the peripheral portion and/or the upper portion of the plate body 10 for receiving tool members 20, 30, 40 therein, and including one or more ribs 110, 120 extended from the upper portion of the plate body 10 and extended inward of the chambers 11, 12 of the plate body 10 respectively, and including one or more projections 111, 121 extended inward of the chambers 11, 12 of the plate body 10 respectively for engaging with and for retaining the tool members 20, 30, 40 within the respective chambers 11, 12, 13 of the plate body 10. The plate body 10 includes a pair of opposite flanges 130 extended inward of the chambers 13 of the plate body 10 for defining a slot 132 between the flanges 130 and for defining an orifice 131 and an opening 133 in the plate body 10 and communicating with the slot 132 of the plate body 10.

Figure 3:
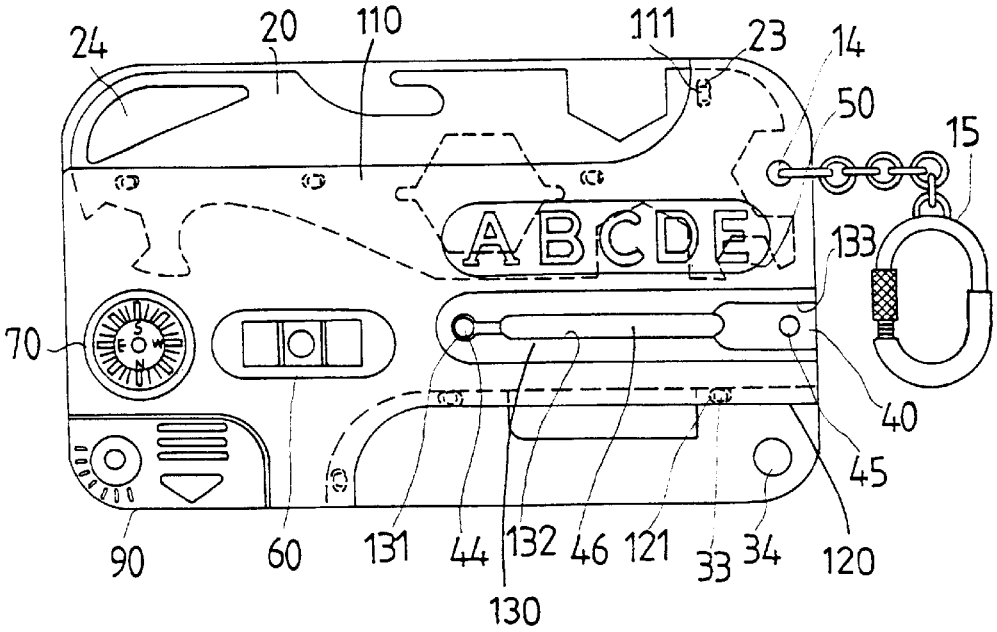
FIG. 3 is an upper plane view of the planer tool housing.

The tool member 20 includes a planer board having one or more notches 21 and one or more engaging apertures 22 formed therein for engaging with and for driving the fasteners or the tool bits, and having one or more cavities 23 formed therein for receiving the projections 111 of the plate body 10 and for detachably securing the tool member 20 to the plate body 10. The tool member 20 is partially exposed out of the plate body 10 and includes a depression 24 formed therein for allowing the user to disengage the tool member 20 from the plate body 10. The rib 110 of the plate body 10 may engage with the tool member 20 (FIG. 3) to stably retain the tool member 20 within the chamber 11 of the plate body 10. The plate body 10 may include a hole 14 formed therein for engaging with a key chain 15 or the like and for attaching to a key or the like.

The tool member 30 includes a casing body (30) having one or more tool elements, such as the saw blade 31, the pair of scissors 32 pivotally secured thereto with a pivot pin 34 and foldable inward of the tool member 30. The tool member 30 includes one or more cavities 33 formed therein for receiving the projections 121 of the plate body 10 and for detachably securing the tool member 30 to the plate body 10, and includes a peripheral portion 36 having a reduced thickness relative to the tool member 30 for engaging into the chamber 12 of the plate body 10 and for defining a peripheral shoulder 37 and for engaging with the plate body 10 and for limiting the inward engagement of the tool member 30 into the chamber 12 of the plate body 10. The tool member 30 preferably includes an outer surface flush with that of the plate body 10, best shown in FIG. 1. The tool member 30 includes a notch 38 formed therein for allowing the user to disengage the tool member 30 from the plate body 10.

Figure 2:
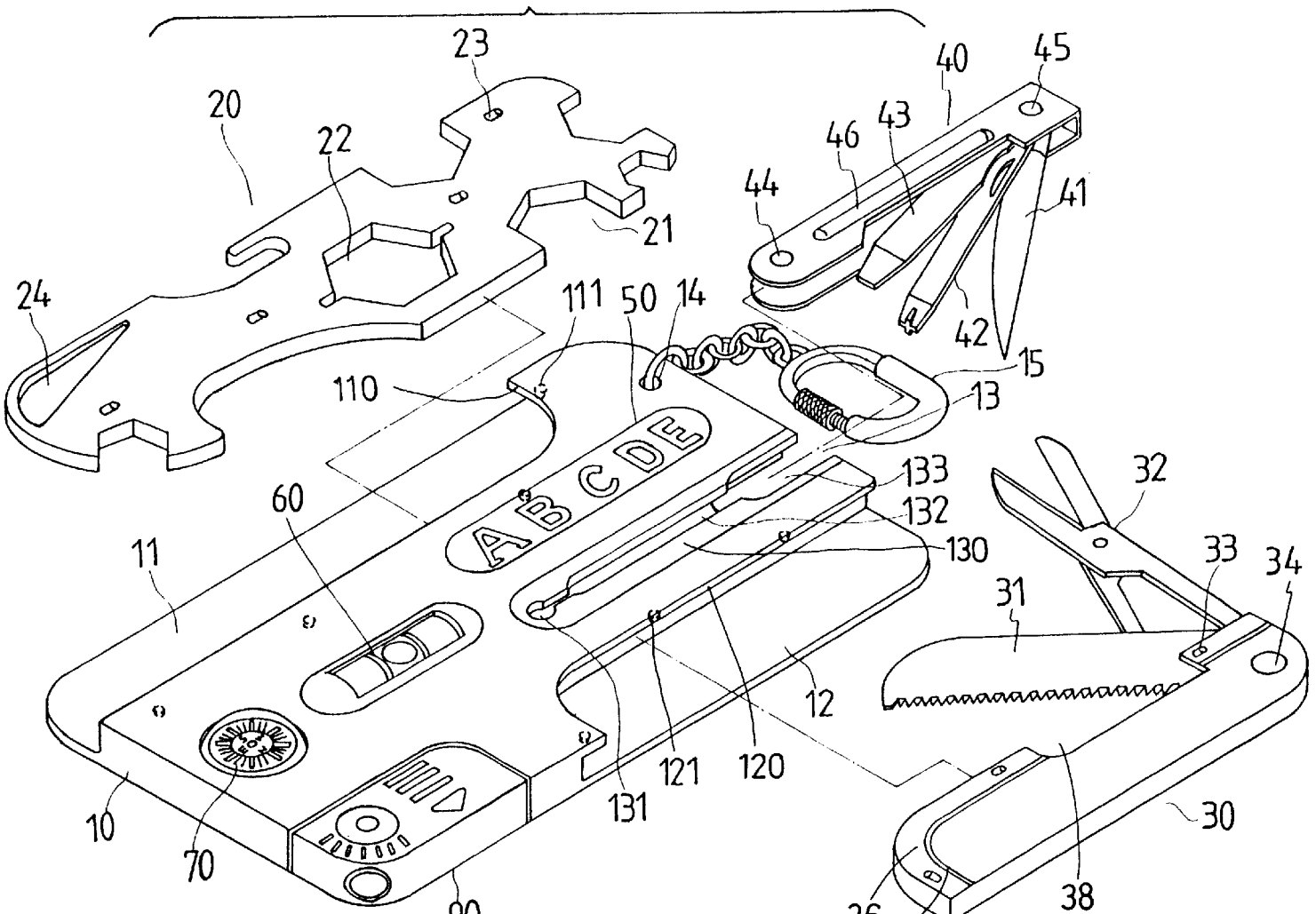
FIG. 2 is an exploded view of the planer tool housing.
Figure 4:
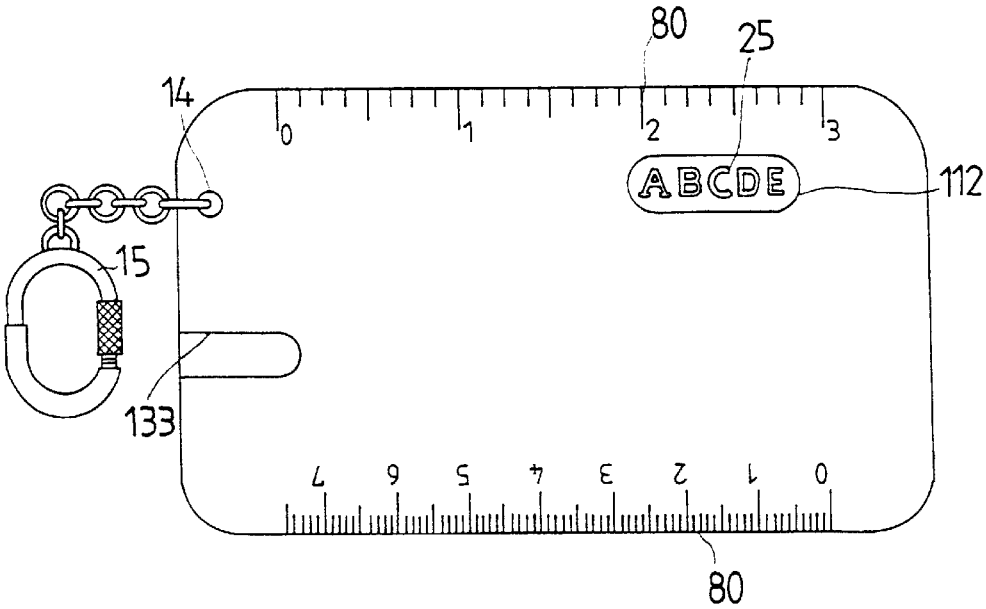
FIG. 4 is a bottom plane view of the planer tool housing.

The tool member 40 also includes a casing body (40) having one or more tool elements, such as the knife blade 41, and/or the screw driver bits 42, 43 pivotally secured thereto with a pivot axle 45 and foldable inward of the tool member 40. The tool member 40 includes a swelling 44 and a bulge 46 formed thereon for engaging into the orifice 131 and the slot 132 of the plate body 10 and for detachably securing the tool member 40 to the plate body 10. The provision of the opening 133 in the plate body 10 allows the tool member 40 to be easily disengaged from the plate body 10. One or more levels 60, and one or more compasses 70 and one or more light devices 90 may further be provided in the plate body 10, such that the planer tool housing may include a number of tool members 20, 30, 40, 60, 70, 90 provided therein. The plate body 10 may include one or more recesses 112, 50 formed in the bottom (FIG. 4) and/or in the upper portion (FIGS. 1–3) of the plate body 10 for receiving a tag 25 or the like therein, or for applying the trademark or the instructions of the products therein. The plate body 10 may include one or more graduations 80 provided in the bottom portion thereof (FIG. 4) for acting as a rule or the like.

It is to be noted that the planer tool housing includes a plate body having a planer configuration and having a pocket size for being received in the pockets of the users, and includes a number of tool members and/or tool elements received therein, such that the planer tool housing may be used for conducting various kinds of works. The tool members 20, 30, 40 may formed as one part of the plate body 10 when the tool members 20–40 are engaged in the plate body 10.

Accordingly, the planer tool housing in accordance with the present invention includes one or more chambers opening toward the side portions of the tool housing for allowing the tool members to be engaged into and removed from the side portions of the planer tool housing, and includes a pocket size for engaging into the pockets of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A planer tool housing comprising:

a plate body including an upper portion and a side portion, and including at least one chamber formed therein and opening toward said side portion of said plate body, and a tool member received in said at least one chamber of said plate body and allowed to be engaged into and disengaged from said plate body from said side portion of said plate body, said tool member including a peripheral portion having a reduced thickness than that of said tool member for engaging into said at least one chamber of said plate body and for defining a peripheral shoulder in said tool member and for engaging with said plate body.

2. The planer tool housing according to claim 1, wherein said at least one chamber of said plate body is formed in said side portion and said upper portion of said plate body for allowing said tool member to be exposed at said side portion and said upper portion of said plate body and for allowing said tool member to be engaged into and disengaged from said plate body from said side portion and said upper portion of said plate body.

3. The planer tool housing according to claim 1 further comprising means for retaining said tool member in said plate body.

4. The planer tool housing according to claim 3, wherein said retaining means includes at least one projection extended from said plate body and extended inward of said at least one chamber of said plate body for engaging with said tool member and for retaining said tool member in said plate body.

5. The planer tool housing according to claim 4, wherein said tool member includes at least one cavity formed therein for receiving said at least one projection and for retaining said tool member in said plate body.

6. The planer tool housing according to claim 1, wherein said plate body includes a rib extended inward of said at least one chamber of said plate body for engaging with said tool member and for retaining said tool member in said plate body.

7. The planer tool housing according to claim 1, wherein said tool member includes at least one engaging aperture formed therein for receiving an object to be driven by the tool member.

8. The planer tool housing according to claim 1, wherein said tool member includes a depression formed therein for facilitating a disengagement of said tool member from said plate body.

9. The planer tool housing according to claim 1, wherein said tool member includes at least one tool element pivotally secured thereto.

10. A planer tool housing comprising:

a plate body including an upper portion and a side portion, and including at least one chamber formed therein and opening toward said side portion of said plate body, and a tool member received in said at least one chamber of said plate body and allowed to be engaged into and disengaged from said plate body from said side portion of said plate body, said tool member including a bulge extended therefrom, said plate body including a slot formed therein and communicating with said at least one chamber thereof for receiving said bulge of said tool member.

11. The planer tool housing according to claim 10, wherein said plate body includes a pair of flanges extended inward of said at least one chamber of said plate body for defining said slot of said plate body.

12. The planer tool housing according to claim 10, wherein said tool member includes a swelling extended therefrom, said plate body includes an orifice formed therein and communicating with said slot of said plate body for receiving said swelling of said tool member.

13. The planer tool housing according to claim 1, wherein said plate body includes an opening formed therein and communicating with said at least one chamber of said plate body for facilitating a disengagement of said tool member from said plate body.

14. A planer tool housing comprising:

a plate body including an upper portion and a side portion, and including at least one chamber formed therein and opening toward said side portion of said plate body, a tool member received in said at least one chamber of said plate body and allowed to be engaged into and disengaged from said plate body from said side portion of said plate body, and at least one level and at least one compass engaged in said plate body.

15. The planer tool housing according to claim 1 further including at least one light device engaged in said plate body.

16. The planer tool housing according to claim 1 further including at least one graduation provided on said plate body.

17. The planer tool housing according to claim 1 further including at least one key key chain coupled to said plate body.

* * * * *